US010408583B2

(12) United States Patent
Isenmann

(10) Patent No.: US 10,408,583 B2
(45) Date of Patent: Sep. 10, 2019

(54) FOAM DARTS

(71) Applicant: Dale Isenmann, Greenville, SC (US)

(72) Inventor: Dale Isenmann, Greenville, SC (US)

( * ) Notice: Subject to any disclaimer, the term of this patent is extended or adjusted under 35 U.S.C. 154(b) by 0 days.

(21) Appl. No.: 15/678,311

(22) Filed: Aug. 16, 2017

(65) Prior Publication Data

US 2018/0051966 A1 Feb. 22, 2018

Related U.S. Application Data

(60) Provisional application No. 62/376,110, filed on Aug. 17, 2016, provisional application No. 62/407,129, filed on Oct. 12, 2016, provisional application No. 62/482,508, filed on Apr. 6, 2017.

(51) Int. Cl.

| | |
|---|---|
| ***A63B 65/02*** | (2006.01) |
| ***F42B 6/00*** | (2006.01) |
| ***F42B 12/74*** | (2006.01) |
| ***F42B 6/08*** | (2006.01) |
| ***F42B 10/22*** | (2006.01) |

(52) U.S. Cl.

CPC ..... *F42B 6/003* (2013.01); *F42B 6/08* (2013.01); *F42B 10/22* (2013.01); *F42B 12/745* (2013.01)

(58) Field of Classification Search

CPC ..... A63H 27/005; F42B 6/003; F42B 6/02; F42B 6/04; F42B 6/08

See application file for complete search history.

(56) References Cited

U.S. PATENT DOCUMENTS

| | | | | | |
|---|---|---|---|---|---|
| 2,467,838 | A * | 4/1949 | Lust | F42B 6/04 | 473/581 |
| 2,828,965 | A * | 4/1958 | Schwitzki | F42B 6/04 | 473/586 |
| 3,735,748 | A * | 5/1973 | Gaylord | F41B 1/00 | 124/44.6 |
| 3,751,037 | A * | 8/1973 | Courneya | F42B 6/06 | 244/3.23 |
| 5,273,293 | A * | 12/1993 | Lekavich | F42B 6/04 | 138/173 |
| 6,083,127 | A * | 7/2000 | O'Shea | A63H 33/18 | 446/213 |
| 6,129,642 | A * | 10/2000 | DonTigny | F42B 6/04 | 473/578 |
| 6,595,880 | B2 * | 7/2003 | Becker | F42B 6/04 | 124/44.5 |
| 9,410,774 | B1 * | 8/2016 | Gallo | F42B 6/04 | |
| 9,459,081 | B2 * | 10/2016 | Chia | F42B 6/08 | |
| 2006/0046877 | A1 * | 3/2006 | Gajda, Jr. | F42B 6/10 | 473/572 |

* cited by examiner

*Primary Examiner* — John A Ricci
(74) *Attorney, Agent, or Firm* — Perkins Law Firm

(57) ABSTRACT

The present invention generally relates to an improved foam dart that operates with improved accuracy. The shaft of the foam dart is shaped with indentions that direct airflow around the dart to improve its accuracy. The dart tip is also connected through a rigid neck portion that further improves the accuracy of the dart during use. An alternative embodiment allows the user to place a pop cap within the dart tip that will explode to cause a loud bang when the dart contacts a hard object at the end of its flight. Side vents direct exhaust gases away from the target to improve safety.

1 Claim, 6 Drawing Sheets

FOAM DARTS

CROSS REFERENCE TO RELATED APPLICATIONS

The present invention claims priority to pending U.S. Provisional Patent Application Nos. 62/376,110, filed Aug. 17, 2016; 62/407,129, filed Oct. 12, 2016; and 62/482,508, filed Apr. 6, 2017; each of which is incorporated herein by reference.

FIELD OF THE INVENTION

The present invention generally relates to foam darts and, more particularly, to improved foam darts that provide increased accuracy and more dynamic response.

BACKGROUND OF THE INVENTION

Toy darts for use in spring activated, or air activated, toy guns have been enjoyed for many years. To insure safety, the body of the darts is typically a foam cylinder with suction cups on the forward end, thereby allowing for the dart to stick to a target. In some embodiments, these darts use a soft, bullet-shaped tip. Though enjoyable, the poor accuracy of toy darts has thwarted wider acceptance. What is needed is an improved dart suitable for use with toy guns wherein the dart has significantly improved accuracy without compromising the safety of the dart. An object of the present invention is to provide a more accurate foam dart to improve the user's experience.

Toy darts also suffer from the lack of dynamic response, wherein successful hits make no sound and often fail to complete suction in the case of suction cup tipped darts. Or, in the case of soft-nosed darts, little to nothing happens when the darts make contact. What is needed is a foam dart that provides increased dynamic response to provide more stimulation for the user and to provide additional feedback in the case of a successful hit. Another object of the present invention is to provide a more dynamic foam dart to improve the user's experience.

SUMMARY OF THE INVENTION

The present invention accomplishes the foregoing objects by providing a more accurate foam dart. The present invention also accomplishes the foregoing objects by providing a more dynamic foam dart.

Though not limited thereto, there are two conventional sizes of high accuracy darts based on the dart's diameter. The preferred size is not a technical limitation but is based on the installed base of toy guns in the market and the desire for the high accuracy darts to be suitable for use with any gun already in use. The current market provides for a diameter shell of ¼ inch to 1 inch with a ½ inch diameter shell, a ⅝ inch diameter shell and a ¾ inch diameter shell being preferred as the sizes and material of construction being significantly the same for many years. The ½ inch shell will be referred to as the small dart herein and the ⅝ and ¾ will be referred to as the large darts.

There are two primary components to the dart with one being the shell and the other being the tip. The shell and tip will be described separately with the understanding that the choice of the combination of shell and tip is not limited as any tip described can be used with any shell described. Furthermore, the various tips described herein may be used with conventional shells thereby improving the performance of conventional shells, and the shells described herein may be used with conventional tips thereby providing an improvement.

The present invention provides an improved foam dart comprising a tip operably affixed to a rigid neck that is disposed within a foam shaft, wherein said foam shaft contains a multiplicity of air directing indentions that cause said improved foam dart to travel with more accuracy. The air directing indentions are preferably flute shaped or ring shaped. The tip is preferably a suction cup, bullet-shaped, crown-shaped, or button-shaped.

In one embodiment described herein, the improved foam dart may be made more dynamic for the user by comprising a tip operably affixed to a rigid neck that is disposed within a foam shaft, wherein said tip contains a firing pin designed to accept and fire a pop cap. This embodiment can have a smooth shaft or it can be an improved accuracy model comprising a multiplicity of air directing indentions disposed upon said foam shaft that cause said improved foam dart to travel with more accuracy. Those indentions are also preferably flute shaped or ring shaped. This embodiment can also have a series of vent holes to safely exhaust gases from the firing of a pop cap.

DESCRIPTION OF THE DRAWINGS

The invention will be more readily understood with reference to the following specification in conjunction with the drawings herein.

DESCRIPTION OF THE PREFERRED EMBODIMENTS

Figure 1:
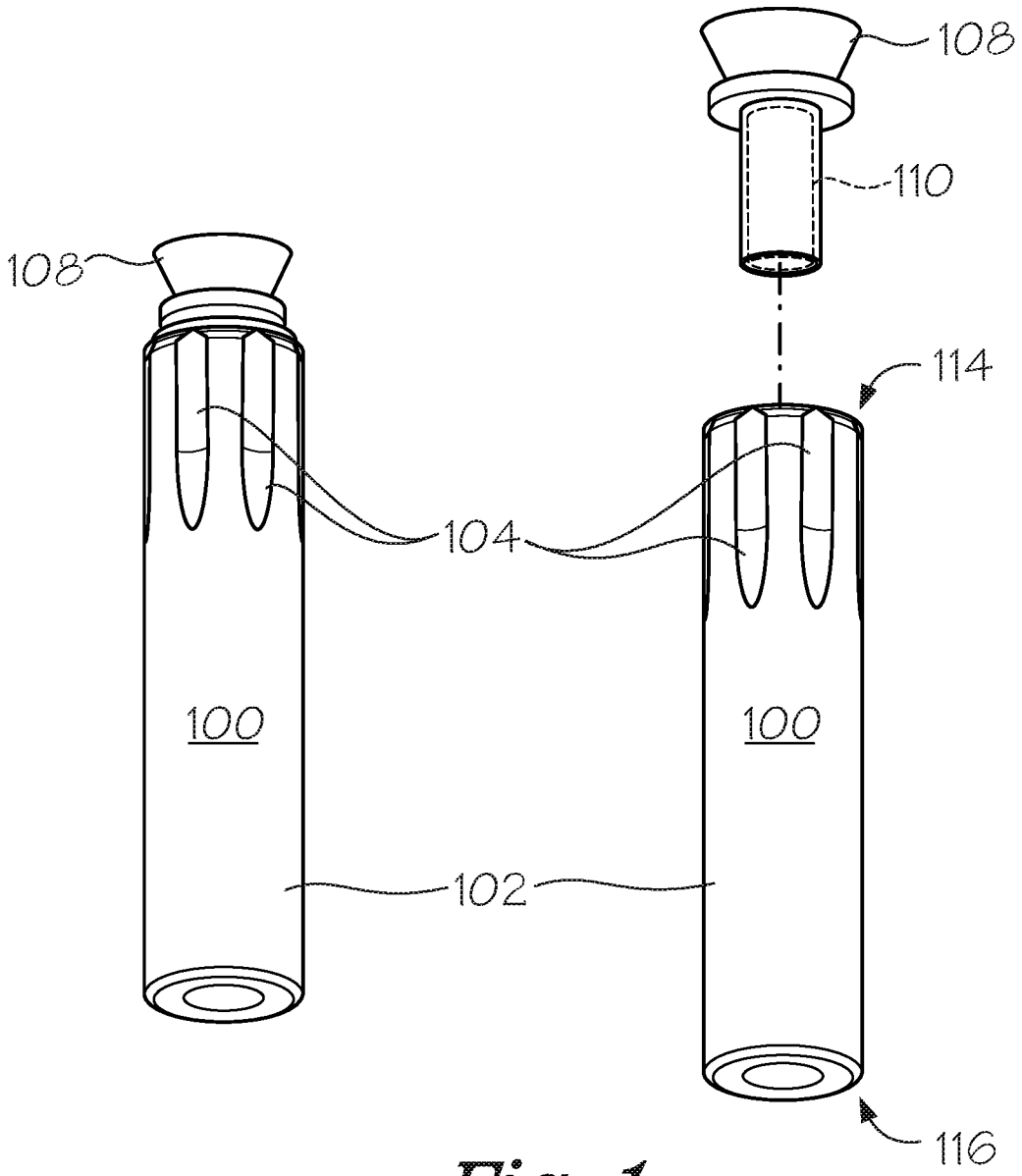
FIG. 1 is a perspective and exploded view of an improved accuracy foam dart according to a preferred embodiment of the invention.

Referring now to FIG. 1, a perspective and exploded view of an improved accuracy foam dart 100 is illustrated for providing improved accuracy according to a preferred embodiment of the invention. This embodiment of dart 100 is comprised of a foam shaft 102 (also referred to as a shell) designed to receive tip 108. The tip contains a substantially rigid neck 110, which in this embodiment is fitted within the lower portion of tip 108. The tip in turn is designed for insertion into the front portion 114 of shaft 102. Front portion 114 is disposed on the opposite end of the back portion 116 of shaft 102.

The flutes 104 along the sides of shaft 102 work in concert with neck 110 to provide improved accuracy. Flutes 104 are preferably symmetrically disposed with 2 to 8 flutes being preferred wherein the flutes extend from the transition between the neck, or narrowed portion, at least one tenth to no more than half the length of the shaft 102. The neck 110 is preferably rigid or semi-rigid and acts, together with the flutes, to provide improved accuracy of the dart.

Figure 2:
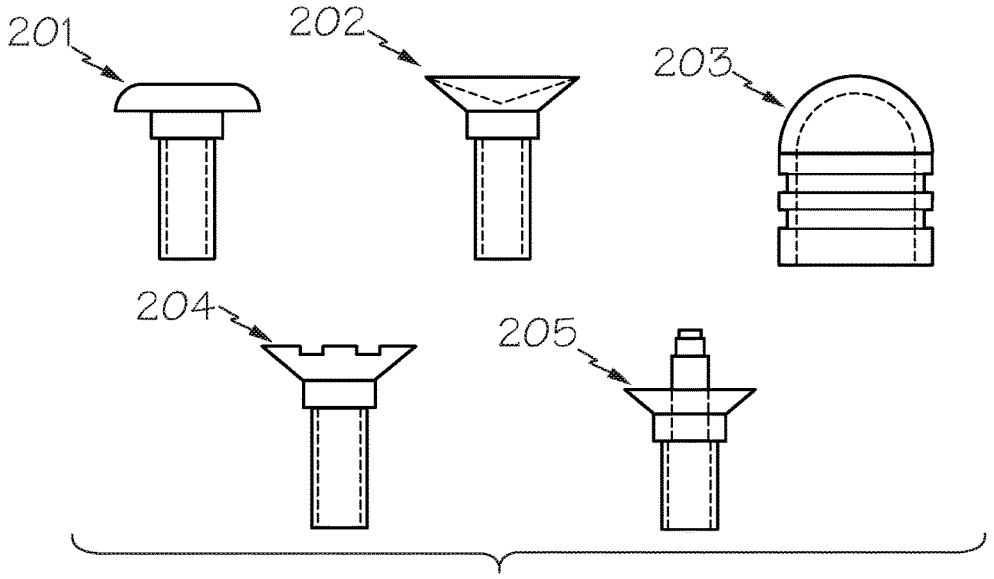
FIG. 2 is a representative view of dart tips according to five preferred embodiments of the invention.

Referring now to FIG. 2, a representative view of five types of dart tips according to five preferred embodiments of the invention is provided for further illustration. Beginning from the left and top to bottom of FIG. 2, the invention is operable with many forms of dart tips, where preferred embodiments are a button-nose tip 201, a suction-cup tip 202, a bullet-nose tip 203, a crown tip 204, or a pop-dart tip 205.

Figure 3:
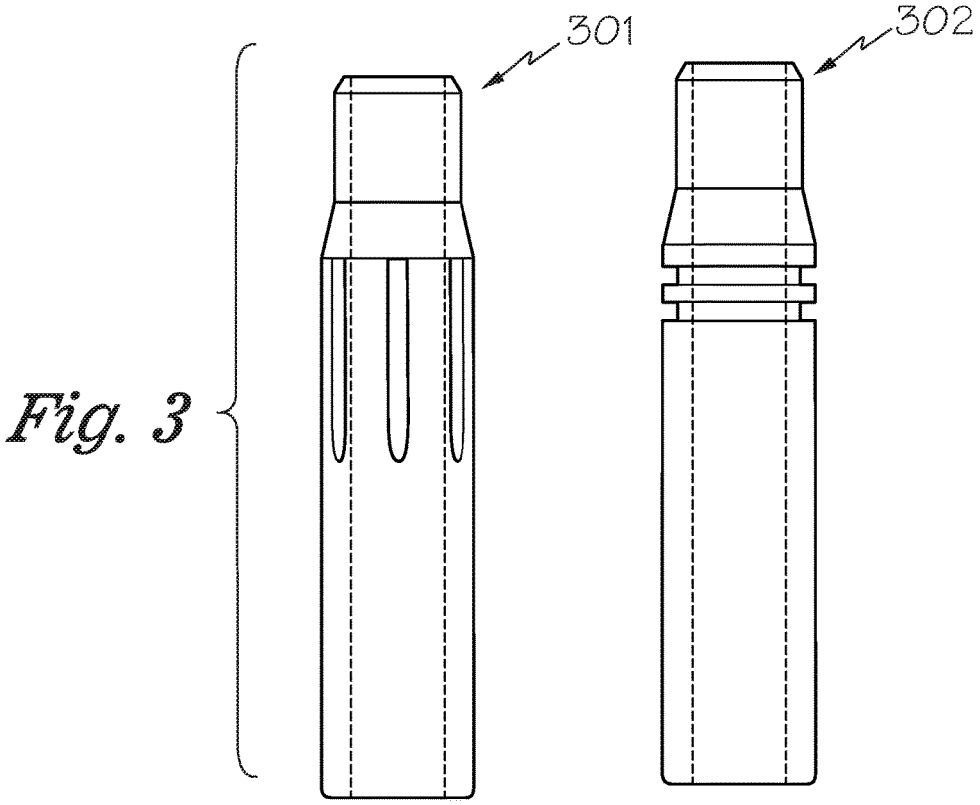
FIG. 3 is a representative view of dart shafts according to two preferred embodiments of the invention.

Referring now to FIG. 3, a representative view of two types of dart shafts according to two preferred embodiments of the invention is provided for further illustration. Beginning from the left of FIG. 3, the invention is operable with many forms of dart shafts where preferred embodiments are a fluted shaft 301 or a ringed shaft 302, where the flutes and rings are referred to herein as air directing indentions that operate to improve the accuracy of the darts.

Preferable embodiments of fluted shafts are described above. The circumnavigating flutes in the ringed shaft also provide improved airflow. At least one groove is preferable with no more than 8 grooves wherein the grooves are disposed towards the front of the dart and are within the front half of the dart as measured along the axis of the cylinder within the shaft. As shown in the following figures, a combination of flutes and rings is also operable to improve accuracy. The form of the shell, with or without rings or flutes, is the most critical component of high accuracy darts. The form, or shape and design, of the shell influences the flow of air over the dart. The darts that have been manufactured in previous years have a tendency to arc and curve in an unpredictable fashion. These new designs directly address these difficulties in traditional dart designs. High accuracy darts are aerodynamically superior in shape and form and fly more consistently in a straight line.

Figure 4:
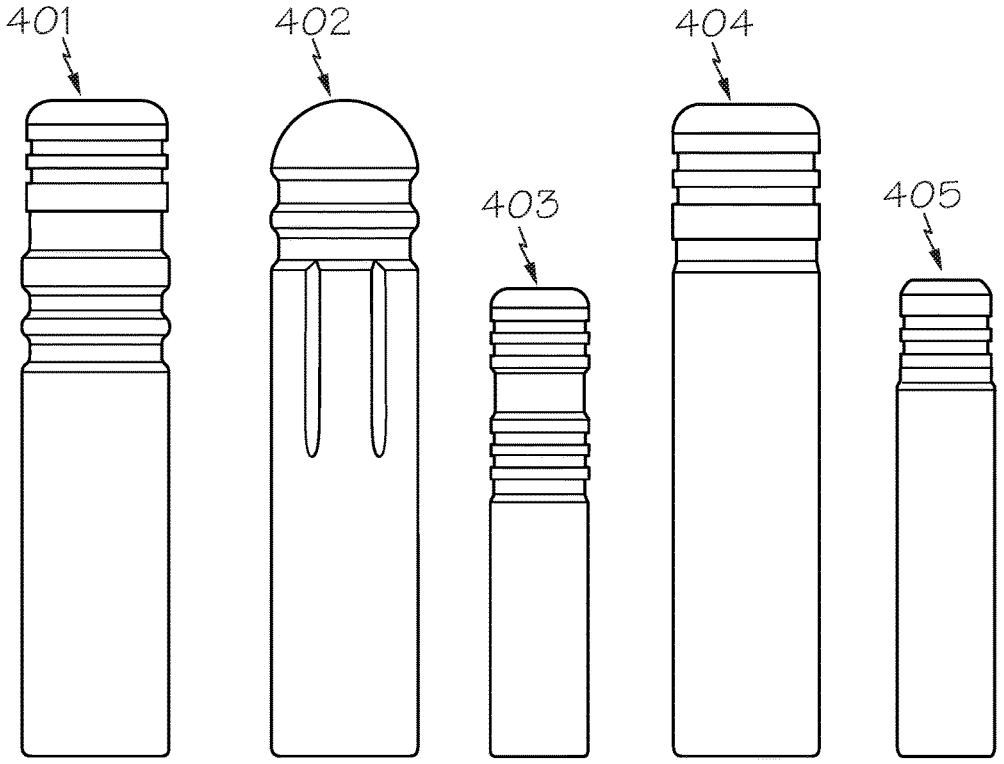
FIG. 4 is a representative view of multiple types of improved accuracy foam darts with bullet-nose tips according to preferred embodiments of the invention.

Referring now to FIG. 4, a representative view of multiple types of improved accuracy foam darts with bullet-nose tips are illustrated according to preferred embodiments of the invention. Beginning from the left of FIG. 4, the invention provides improved accuracy using many forms of bullet-nose tips and shafts where preferred embodiments are shown as a large ringed bullet-nose tip with a ringed shaft 401, large ringed and fluted bullet-nose tip with a fluted shaft 402, a small ringed bullet-nose tip with ringed shaft 403, a large ringed bullet-nose tip with smooth shaft 404, and a small ringed bullet-nose tip with smooth shaft 405.

Figure 5:
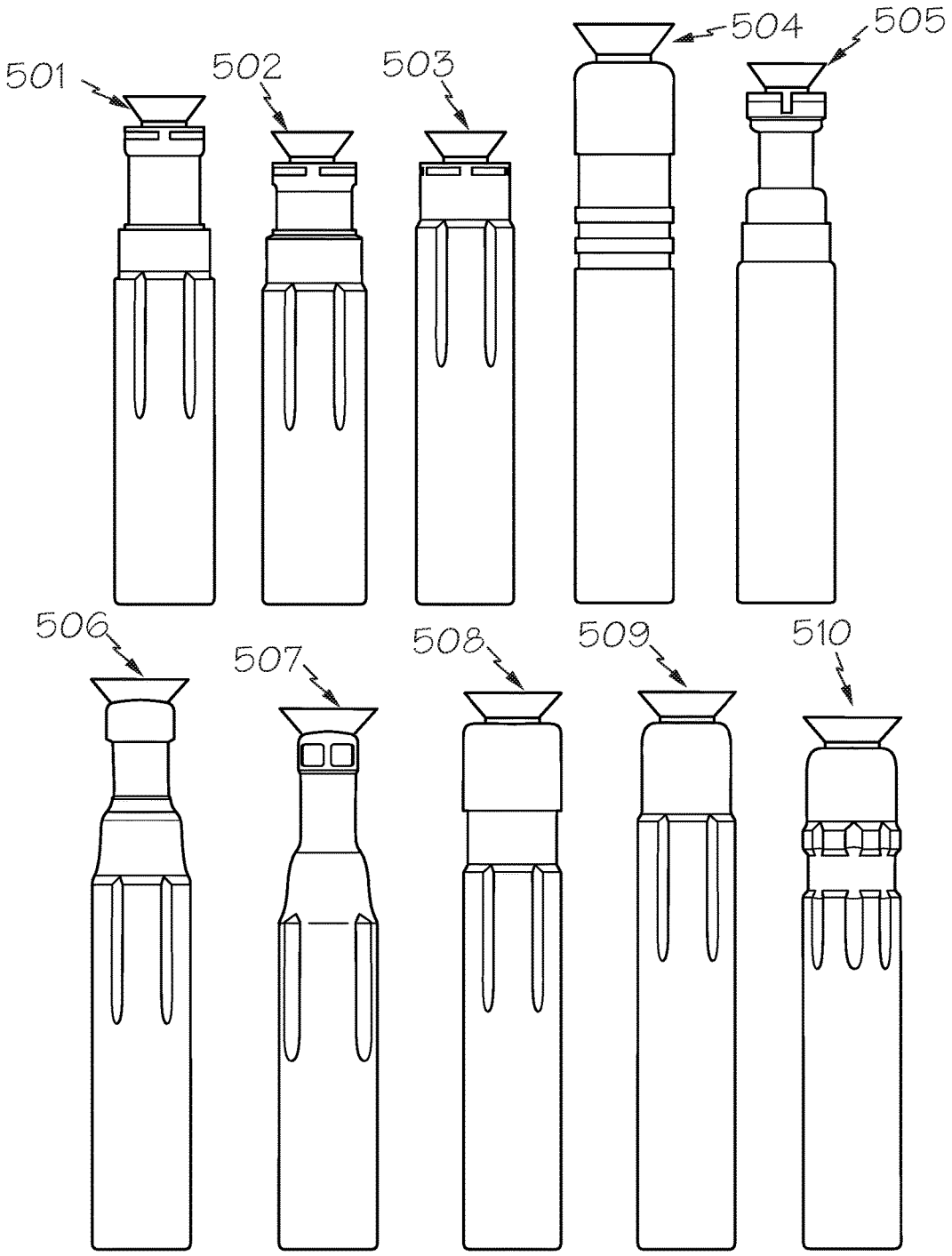
FIG. 5 is a representative view of multiple types of improved accuracy foam darts with suction-cup tips according to preferred embodiments of the invention.

Referring now to FIG. 5, a representative view of multiple types of improved accuracy foam darts with suction-up tips are illustrated according to preferred embodiments of the invention. Beginning from the left of FIG. 5, the invention provides improved accuracy using many forms of suction-cup tips and shafts where preferred embodiments are shown as a large extended-length-neck suction-cup tip with fluted shaft 501, a large-necked suction-cup tip with fluted shaft 502, another large-necked suction-cup tip with fluted shaft 503, a small wide-neck suction-cup tip with ringed shaft 504, a small narrow-neck suction-cup tip with smooth shaft 505, a small narrow-neck small-suction-cup tip with fluted shaft 506, another small narrow-neck suction-cup tip with fluted shaft 507, a small wide-neck suction-cup tip with fluted shaft 508, a small foam-neck suction-cup tip with fluted shaft 509, and a small foam-neck suction-cup tip with dual fluted shaft 510.

Figure 6:
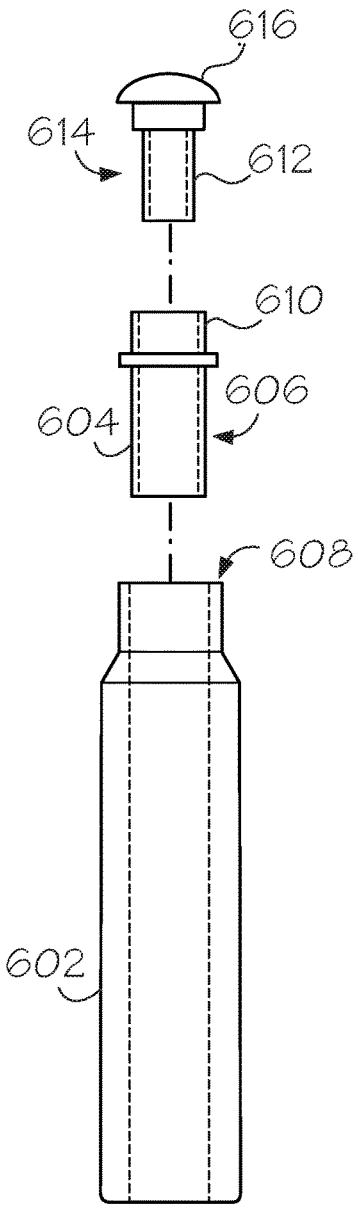
FIG. 6 is an exploded view of an improved accuracy foam dart with a button-nose tip according to a preferred embodiment of the invention.

Referring now to FIG. 6, an exploded view of an improved accuracy foam dart with a button-nose tip according to a preferred embodiment of the invention is illustrated to reveal the various components of such dart. In this example, the shaft 602 is smooth, i.e., non-fluted and non-ringed. The lower portion 604 of neck 606 is illustrated to indicate where and how it inserts into the front 608 of shaft 602. While the embodiment of FIG. 1 used a neck 110 that was housed within the lower portion of tip 108, this example and the following examples use another embodiment of the neck that is illustrated separately from the tip and shaft for additional clarity. Placement and length of the neck can vary and is not critical to each design. It is only important that the neck is substantially rigid. Preferred embodiments typically use hard plastic to form the neck. Here, upper portion 610 of neck 606 is designed to accept insertion of the lower portion 612 of button-nosed tip portion 614. Button-nose tip 616 provides one of many tip shapes for the invention.

Figure 7:
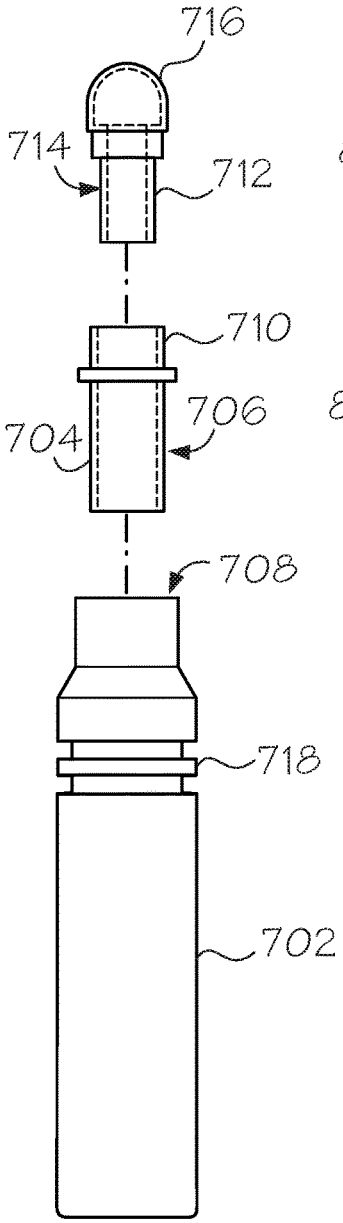
FIG. 7 is an exploded view of an improved accuracy foam dart with a bullet-nose tip according to a preferred embodiment of the invention.

Referring now to FIG. 7, an exploded view of an improved accuracy foam dart with a bullet-nose tip according to a preferred embodiment of the invention is illustrated to reveal the various components. In this example, the shaft 702 is ringed instead of smooth, i.e., non-fluted. The lower portion 704 of neck 706 is illustrated to indicate where and how it inserts into the front 708 of shaft 702. Upper portion 710 of neck 706 is designed to accept insertion of the lower portion 712 of bullet-nose tip portion 714. Bullet-nose tip 716 provides one of many tip shapes for the invention. The rings 718 that provide the ringed shaft 702 with improved accuracy are also visible in this example.

It is also possible to incorporate other objects in this design to improve the dynamic response of the foam dart. More specifically, additional embodiments of the invention provide a pop tip that can receive a pop cap from a standard cap pistol, thereby providing an audible report when contacting a hard object. Cap guns utilizing ring caps comprising cups with gunpowder therein are widely available in various sizes and charge loads. The pop tip receives a single cap, such as from a ring cap or linear assembly of strip caps, with friction release thereby providing a quick replacement upon use.

Figure 8:
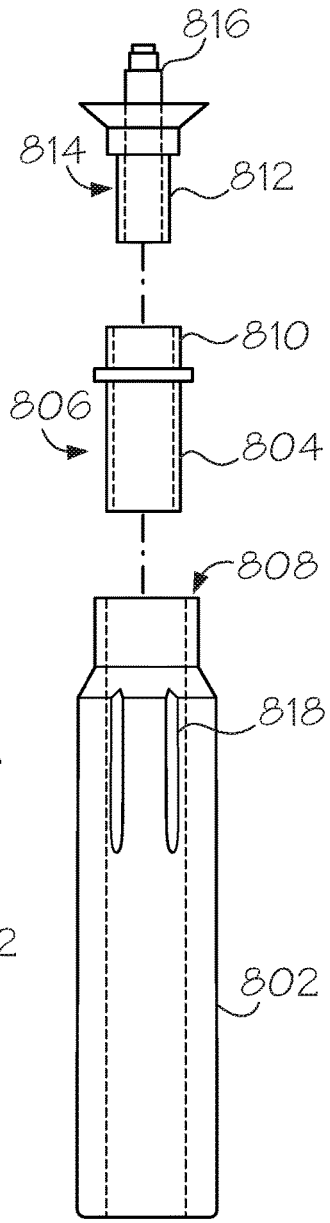
FIG. 8 is an exploded view of an improved accuracy foam dart with a pop-dart tip according to a preferred embodiment of the invention.

Referring now to FIG. 8, an exploded view of an improved accuracy foam dart with a pop-dart tip according to a preferred embodiment of the invention is illustrated to reveal the various components. In this example, the shaft 802 is fluted instead of smooth, i.e., non-ringed. The lower portion 804 of neck 806 is illustrated to indicate where and how it inserts into the front 808 of shaft 802. Upper portion 810 of neck 806 is designed to accept insertion of the lower portion 812 of the pop-dart tip portion 814. Pop-dart tip 816 provides one of many tip shapes for the invention. The flutes 818 that provide the fluted shaft 802 with improved accuracy are also visible in this example.

Figure 9:
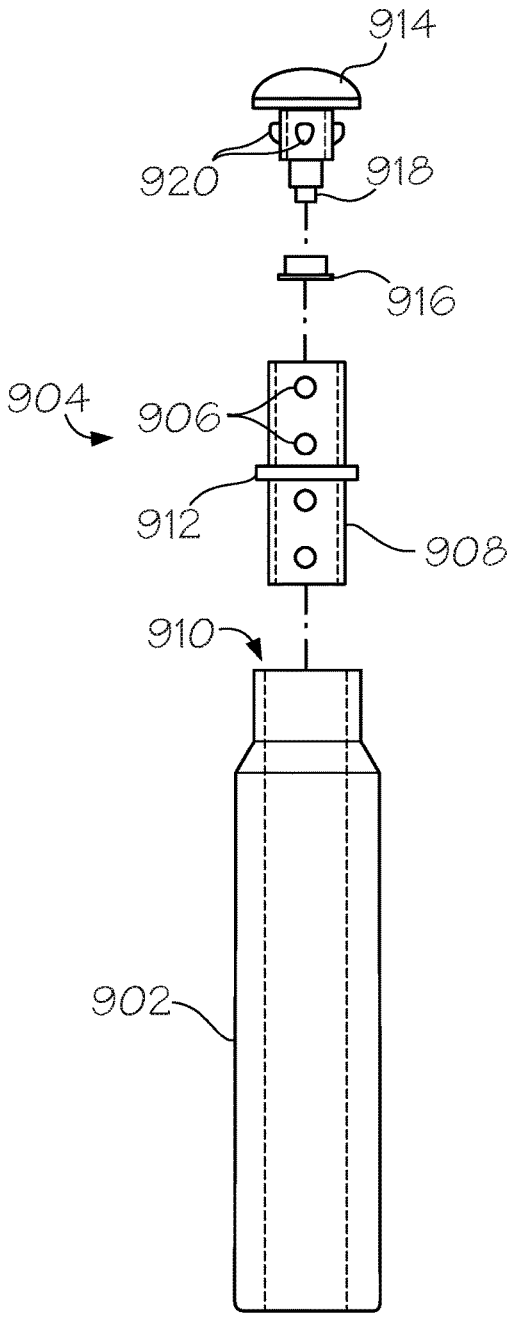
FIG. 9 is an exploded view of an improved accuracy foam dart with a pop-dart tip according to another preferred embodiment of the invention.
Figure 10:
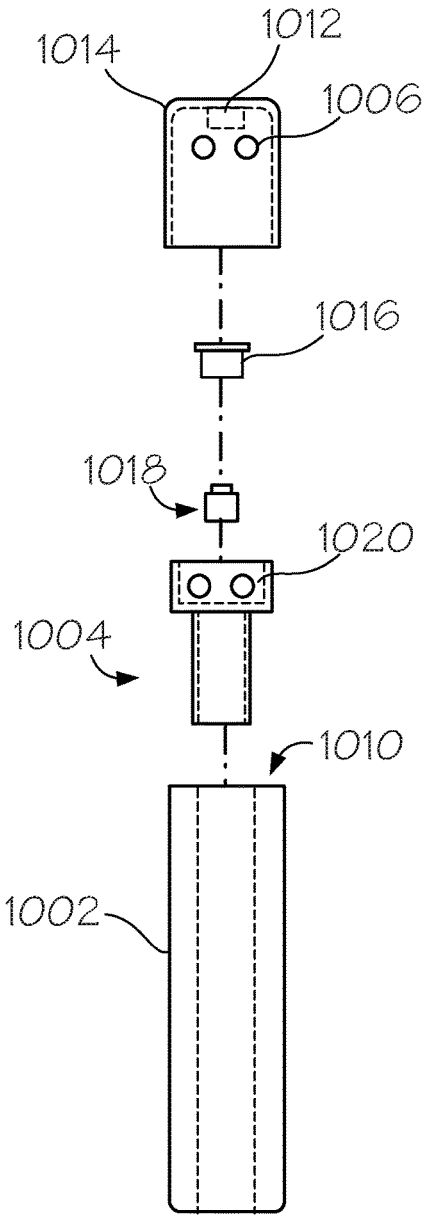
FIG. 10 is an exploded view of an improved accuracy foam dart with a pop-dart tip according to another preferred embodiment of the invention.

As illustrated further in FIGS. 9 and 10, the tip of a pop-dart embodiment preferably comprises at least one locking lug that reversibly engages with a void in the front portion of the coupler, thereby reversibly securing the tip in the coupler during use while allowing removal to replace a spent pop cap. To unlock the tip from the coupler the operator twists and pulls the firing assembly out of the voids allowing for the removal of the spent cap and insertion of a new cap.

Referring now to FIG. 9, an exploded view of an improved accuracy foam dart with a pop-dart tip according to a preferred embodiment of the invention is illustrated to describe its various parts and pieces. A beveled foam shaft 902 is disposed as the outermost portion of the foam dart. A specialized neck 904 is provided with vent holes 906 to provide a path for escaping gases when the pop-dart is operated. Holes 906 also provide the female portion of the locking mechanism mentioned in the previous paragraph. In this embodiment, back 908 of neck 904 is inserted into the front 910 of foam shaft 902 until striker plate 912 is flush with the outermost end of shaft 902.

During normal operation, neck 904 is already inserted into shaft 902 and the tip is easily removable for loading pop caps. A user removes the tip for loading and a disposable pop cap 916 is placed over firing pin 918. The user then presses the entire dart tip back into neck 904 so that contact head 914 is facing outwards. The dart is now ready for use.

The locking mechanism is more clearly visible in FIGS. 9 and 10 as protuberances 920 and 1020, respectively, which operate with holes 906 and 1006, respectively. In normal operation, the embodiment of FIG. 9 operates as follows. The user presses the tip into neck 904 until protuberances 920 operate as the male portion to engage within the upper vent holes 906, operating as the female portion, to hold the tip in place. Vent holes 906 are sized at approximately the same diameter as protuberances 920 so as to allow entry of protuberances 920 into vent holes 906, whereby the tip is locked in place.

The entire dart is then loaded into a standard foam dart gun for use. When fired from a foam dart gun, the dart is propelled forward out of the gun. When contact head 914 makes contact with a hard surface at the end of its flight, it forces firing pin 918 into pop cap 916, which causes the pop cap to fire. Exhaust gases from the pop cap are safety directed away from contact head 914 by venting those gases perpendicularly out of vent holes 906, which provide a passage within neck 904. In other words, neck 904 is hollow and thereby allows hot gases from the pop cap to flow outward through vent holes 906. In this way, the hot gases do not come into contact with the surface struck by the dart's flight. This provides improved safety in the case where the surface struck is a person or, worse yet, an eye or ear of a person.

An alternative embodiment of a pop dart is illustrated in FIG. 10. Here shaft 1002 is similar to shaft 902 from FIG. 9. But all of the working mechanisms are different from FIG. 9. More specifically, neck 1004 is designed for insertion into the front 1010 of shaft 1002, but firing pin 1018 is placed on the opposite end of neck 1004 in this embodiment. In normal use, firing pin 1018 is securely fastened to the top of neck 1004, which is then inserted into the front 1010 of shaft 1002 where it thereafter remains. Bullet-nose tip 1014 contains a hard-surface striker 1012 and vent holes 1006.

The locking mechanism of the embodiment of FIG. 10 operates as follows. The user presses the tip into neck 1004 until protuberances 1020 engage within the vent holes 1006 to hold the tip firmly in place when affixed to neck 1004. Vent holes 1006 are sized at approximately the same diameter as protuberances 1020 so as to allow entry of protuberances 1020 into vent holes 1006. Multiple other forms of locking mechanisms are possible in each of the above embodiments because the plastic material used in foam darts is flexible.

To load this embodiment for firing, a user removes tip 1014 and places a pop cap 1016 over firing pin 1018. Tip 1014 is then inserted back over neck 1004 to substantially cover neck 1004. When inserted into a foam dart gun and fired, the dart is propelled outward. When tip 1014 comes into contact with a hard surface at the end of its flight, striker 1012 is forced inward towards pop cap 1016, which in turns fires on firing pin 1018. As with the previous embodiment, hot gases from the pop cap escape perpendicularly outward from the side of tip 1014 through vent holes 1006 to provide a measure of safety during use.

The invention has been described with reference to the preferred embodiments without limit thereto. Additional embodiments and improvements may be realized which are not specifically set forth herein but which are within the scope of the invention as more specifically set forth in the claims appended hereto.

The invention claimed is:

1. A foam dart with improved accuracy comprising a tip operably affixed to a substantially rigid neck wherein said rigid neck is disposed within a foam shaft, wherein said foam shaft contains a multiplicity of air directing indentions extending along the shaft less than the entire length of the shaft, and wherein one distal end of said foam shaft comprises a tapered portion at the junction between said tip and said foam shaft.

* * * * *